US007648376B1

(12) United States Patent
Borgstrom

(10) Patent No.: US 7,648,376 B1
(45) Date of Patent: Jan. 19, 2010

(54) 25KV LOADBREAK ELBOW AND BUSHING INCREASED FLASHOVER DISTANCE

(75) Inventor: Alan D. Borgstrom, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/384,533

(22) Filed: Apr. 6, 2009

Related U.S. Application Data

(60) Provisional application No. 61/137,185, filed on Jul. 28, 2008.

(51) Int. Cl.
*H01R 13/53* (2006.01)

(52) U.S. Cl. ..... 439/181; 439/921

(58) Field of Classification Search ..... 439/181, 439/185, 186, 187, 88, 89, 921
See application file for complete search history.

(56) References Cited

U.S. PATENT DOCUMENTS 3,587,035 A 6/1971 Kotski
3,617,987 A * 11/1971 Sankey ..... 439/184
3,826,860 A 7/1974 De Sio et al.
4,175,815 A * 11/1979 Andersen et al. ..... 439/89
4,722,694 A 2/1988 Makal et al.
5,857,862 A 1/1999 Muench et al.
5,957,712 A 9/1999 Stepniak
6,168,447 B1 1/2001 Stepniak et al.
6,231,404 B1 5/2001 Lichy
6,416,338 B1 * 7/2002 Berlovan ..... 439/187
6,504,103 B1 * 1/2003 Meyer et al. ..... 174/167
6,811,418 B2 11/2004 Jazowski et al.
6,939,151 B2 9/2005 Borgstrom et al.
7,044,760 B2 5/2006 Borgstrom et al.
7,083,450 B1 8/2006 Hughes
7,216,426 B2 5/2007 Borgstrom et al.

OTHER PUBLICATIONS

Thomas & Betts, "Reliability Delivered: We Mold Solutions", *Elastimold*; 2006.

* cited by examiner

*Primary Examiner*—Neil Abrams
(74) *Attorney, Agent, or Firm*—Hoffmann & Baron, LLP

(57) ABSTRACT

A loadbreak connector formed by a power cable elbow and a bushing insert with increased flashover distance is disclosed. The power cable elbow includes a conductive member having an energized portion and a non-energized portion, a cable receiving end, a loadbreak bushing insert receiving end with an elbow cuff that extends beyond the energized portion. The bushing insert includes an insulative outer housing and an insulative interface sleeve. The insulative outer housing has an axial bore with a conductive socket, a first, second end mid-section, and a transition shoulder portion between the second end section and the mid-section. The insulative interface sleeve extends over the outer housing from the mid-section to the second end section. When the power cable elbow is installed on the second end section, the flashover distance from the top of the second end section to the bottom of the elbow cuff is increased.

22 Claims, 5 Drawing Sheets

25KV LOADBREAK ELBOW AND BUSHING INCREASED FLASHOVER DISTANCE

This application claims priority from provisional application Ser. No. 61/137,185, filed on Jul. 28, 2008, which is incorporated herein in its entirety.

FIELD OF THE INVENTION

The present invention relates to separable electrical connectors and more particularly to improvements in separable electrical connectors, such as loadbreak connectors and deadbreak connectors, to reduce flashover.

BACKGROUND OF INVENTION

Loadbreak connectors used in conjunction with 15 and 25 KV switchgear generally include a power cable elbow connector having one end adapted for receiving a power cable and another end adapted for receiving a loadbreak bushing insert. The end adapted for receiving the bushing insert generally includes an elbow cuff for providing an interference fit with a molded flange on the bushing insert. This interference fit between the elbow cuff and the bushing insert provides a moisture and dust seal therebetween. An indicator band may be provided on a portion of the loadbreak bushing insert so that an inspector can quickly visually determine proper assembly of the elbow cuff and the bushing insert.

The elbow cuff forms a cavity having a volume of air which is expelled upon insertion of the bushing insert. During initial movement of the loadbreak connectors in the disassembly operation, the volume of air in the elbow cavity increases but is sealed off at the elbow cuff resulting in a decrease in pressure within the cavity. The dielectric strength of the air in the cavity decreases with the decrease in air pressure. Although this is a transient condition, it occurs at a critical point in the disassembly operation and can result in dielectric breakdown of the opening interface causing a flashover or arc to ground. The occurrence of flashover is also related to other parameters such as ambient temperature, the time relationship between the physical separation of the connectors and the sinusoidal voltage through the loadbreak connectors.

Another reason for flashover while switching loadbreak connectors prior to contact separation is attributed to a decrease in dielectric strength of the air along the interface between the bushing insert and the power cable elbow to ground. As earlier described, a decrease in air pressure occurs momentarily in the sealed cavity between the elbow cuff and the bushing insert flange. The lower pressure in the cavity reduces the dielectric strength of the air along the connection interface, which can possibly result in flashover.

In the prior art 25 kV loadbreak connectors, the cuffs on the power cable elbow do not extend past the energized portion of the probe (see FIG. 2). Moreover, the conductive jacket on the bushing is not shielded by insulation (see FIG. 1). Consequently, the flashover distance was simply the distance ("D") between the top of the bushing insert (i.e., the end of the bushing insert connected to a power cable elbow) to the conductive jacket around the mid-section of the bushing insert (see FIG. 3). There were no measures taken to reduce flashover by increasing the flashover distance. Prior art 35 kV loadbreak elbows have used extended elbow cuffs to increase the flashover distance.

Another problem encountered with prior art loadbreak connectors is that it is difficult to insert one end of the loadbreak bushing insert into the power elbow connector and the opposite end into a bushing well. In particular, because the interface surfaces of the loadbreak bushing insert and the power elbow connector are typically made from a rubber material, substantial frictional forces make it difficult to insert the loadbreak bushing insert into the power elbow, even when lubricated. When the loadbreak connector is assembled, the rubber to rubber surfaces tend to stick together before the elbow connector is properly seated on the bushing insert.

Accordingly, it would be advantageous to design a loadbreak connector system that includes a power cable elbow and a loadbreak bushing insert, which reduces or prevents the possibility of a flashover upon switching of the connectors. In addition, there is a need for a sleeve made from a low coefficient of friction material that reduces the friction between the power cable elbow and the bushing insert during connection and disconnection.

SUMMARY OF THE INVENTION

In accordance with the present invention, a loadbreak connector with increased flashover distance is provided. The loadbreak connector includes a power cable elbow and a bushing insert. The power cable elbow includes: a cable receiving end; a loadbreak bushing insert receiving end having an open end portion; a conductive member extending from the cable receiving end to the bushing insert receiving end; and an elbow cuff. The conductive member includes an energized portion and a non-energized portion at the bushing insert receiving end. The elbow cuff is circumferentially disposed around the open end portion and extends beyond the energized portion of the conductive member.

The bushing insert includes an insulative outer housing, a conductive socket and an insulative interface sleeve. The insulative outer housing has an axial bore therethrough, a first end section dimensioned for sealing in a bushing well, a second end section dimensioned for insertion into the power cable elbow, a mid-section that is radially larger than the first and second end sections and has a conductive portion for attachment of a ground conductor, and a transition shoulder portion between the second end section and the mid-section. The conductive socket is disposed within the axial bore of the housing and the insulative interface sleeve extends over the outer housing from the mid-section to the second end section. When the power cable elbow is installed on the second end section, the flashover distance from the top of the second end section to the bottom of the elbow cuff is increased.

The insulative interface sleeve can have an extended interface sleeve section that extends at least one inch from the transition shoulder portion towards the first end. In a first embodiment, when the power cable elbow is installed on the second end section, the elbow cuff extends beyond the insulative interface sleeve and, preferably, beyond the energized portion of the conductive member. In a second embodiment, when the power cable elbow is installed on the second end section, the insulative interface sleeve extends beyond the elbow cuff and, preferably, beyond the energized portion of the conductive member.

The insulative interface sleeve can be bonded to the outer housing. In preferred embodiments, the insulative interface sleeve is made from a thermoplastic material, which preferably, has a melting temperature of at least 120° F. The insulative interface sleeve can also be made from a thermosetting plastic.

The conductive member of the power cable elbow preferably has two portions; an energized and a non-energized portion. The energized portion of the conductive member is made from an electrically conductive material (e.g., copper or aluminum) and the non-energized portion is made of a non-electrically conductive material, preferably a ceramic material.

BRIEF DESCRIPTION OF THE FIGURES

The preferred embodiments of the loadbreak elbow and bushing of the present invention, as well as other objects, features and advantages of this invention, will be apparent from the accompanying drawings wherein.

DETAILED DESCRIPTION OF THE INVENTION

Figure 1:
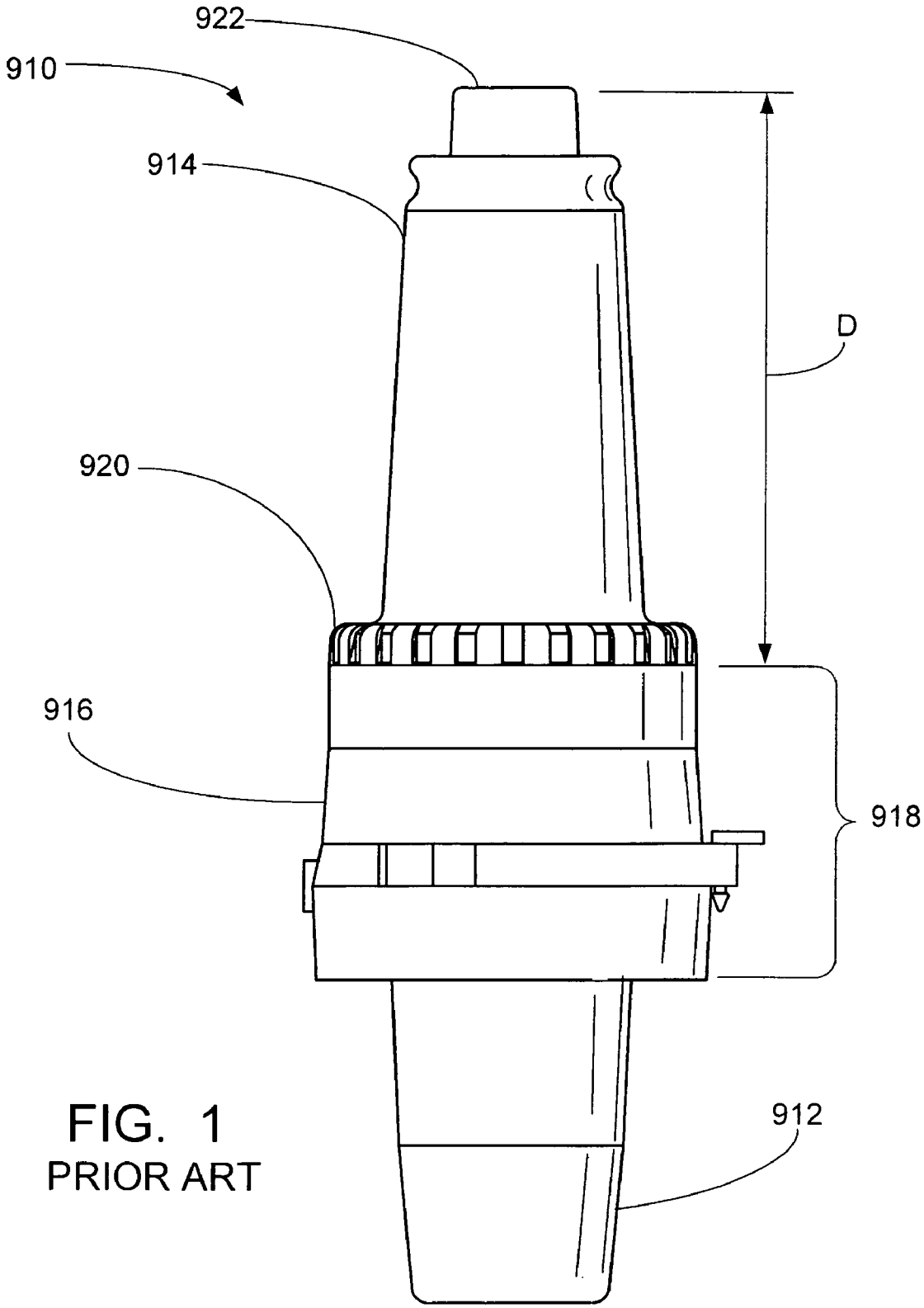
FIG. 1 PRIOR ART
FIG. 1 is a prior art bushing insert.

The present invention improves loadbreak switching performance by increasing the flashover distance between the power cable elbow and the bushing insert. In particular, the present invention improves 25 KV loadbreak switching performance by increasing flashover distance on both the elbow and bushing. With respect to the elbow, the cuff is lengthened so that it extends past the energized end of the central probe (also referred to herein as the conductive member). In the prior art, the elbow cuff did not extend beyond the energized end of the central probe, which resulted in a shorter flashover distance. In addition, the end of the probe contains a non-conductive, arc extinguishing material that is secured to the distal end of the probe.

The bushing of the present invention is also designed to increase the flashover distance by covering a portion of the bushing mid-section (constructed of conductive material) with a plastic sleeve or shell so that any flashover arc has to travel farther to reach the conductive material. The length of the cuff on the elbow and the length of the plastic sleeve extension are such that when the two are coupled together, the plastic sleeve is fully covered by the cuff. In a first embodiment, the cuff extends beyond the end of the plastic sleeve by at least one-quarter of an inch and, most preferably by at least one-half inch, and also extends beyond the energized portion of the conductive member. In a second embodiment, the plastic sleeve extends beyond the end of the cuff by at least one-quarter of an inch and, most preferably by at least one-half inch, and also extends beyond the energized portion of the conductive member. Loadbreak connectors with increased flashover distances on elbows and bushings, as well as sleeves and visual indicators for bushing inserts are disclosed in U.S. Pat. No. 6,939,151, U.S. Pat. No. 7,044,760 and U.S. Pat. No. 7,216,426, all of which are incorporated herein in their entirety.

The power cable elbow includes a cable receiving end, a loadbreak bushing insert receiving end, a conductive member and an elbow cuff. The cable receiving end connects to a high voltage cable in a conventional manner and the bushing insert receiving end has an open end portion for receiving the bushing insert. The conductive member extends from the cable receiving end to the bushing insert receiving end and has an energized portion and a non-energized portion at the bushing insert receiving end. The non-energized portion prevents accidental grounding of the conductive member when it is inserted into the bushing insert. The elbow cuff is circumferentially disposed around the open end portion of the bushing insert receiving end and, preferably, extends beyond the energized portion of the conductive member. The function of the elbow cuff is explained in more detail below.

The bushing (also referred to herein as the bushing insert) includes an insulative outer housing, a first end section, a second end section, a mid-section, a transition shoulder portion between the second end section and the mid-section; a conductive socket disposed within the axial bore of the housing; and an insulative interface sleeve. The first end section of the insulative outer housing is dimensioned for sealing in a bushing well and the second end section is dimensioned for insertion into the power cable elbow connector. The conductive socket is located in the axial bore of the insulative outer housing and receives the conductive member of the power cable elbow. The mid-section is radially larger than the first and second end sections and has a conductive portion on the exterior surface for attachment of a ground conductor. The bushing also has a transition shoulder portion between the second end section and the mid-section. The insulative interface sleeve is preferably made from a plastic material and extends over the insulative outer housing of the bushing insert from the mid-section to the second end section. When the power cable elbow is installed on the bushing insert, the flashover distance from the top of the bushing insert to the bottom of the elbow cuff is increased due to the insulative interface sleeve and the extended elbow cuff.

The loadbreak connector of the present invention increases the flashover distance between the top of the bushing insert (i.e., the end connected to a power cable elbow) to the conductive jacket around the mid-section of the bushing insert by extending the elbow cuff on the power cable elbow past the energized portion of the probe. In addition, a plastic interface sleeve extends from the top of the bushing insert and overlaps the conductive jacket on the bushing, which further increases the flashover distance. In another embodiment, insulating rubber is molded over the bushing jacket in place of the sleeve to increase the flashover distance.

In a second embodiment, the plastic insulative sleeve extends further past the mid section of the bushing than in the embodiment described above so that the insulative sleeve extends beyond the edge of the cuff after the elbow is fully seated. Most preferably, the sleeve extends all the way to the grounding tab. The lengthened sleeve of the second embodiment has an end portion that remains visible after the elbow is fully seated. In contrast, when the elbow for the first embodiment of the present invention is fully seated, the end of the cuff extends to at least the end of the sleeve, preferably beyond the end of the sleeve, so that the sleeve is covered by the cuff and is no longer visible.

The portion of the sleeve that remains visible after the elbow is fully seated can be a first color while the rest of the sleeve (i.e., that portion covered when the elbow is fully seated) is a different, preferably contrasting, second color. Hence, the user still has a visual indication of proper seating even though a portion of the sleeve is still visible. If the first color of the sleeve is still visible, the user knows that the elbow is not yet properly seated. When the elbow is properly seated, only a ring formed by the second color at the bottom of the sleeve is visible. The exposed portion of the sleeve that provides visual indication can also have multiple colors and/or a pattern to enhance the visual difference between the part of the sleeve that is covered, when the elbow is fully seated, and the bottom of the sleeve that remains visible. In a similar manner, the "covered portion" of the sleeve (i.e., the portion covered by the fully seated elbow) can also have multiple colors and/or a pattern.

The extended sleeve of the second embodiment extends further over the mid-section of the bushing than in the first embodiment so that the arc length is increased. Preferably, the extended sleeve also extends beyond the energized portion of the conductive member. The extended sleeve thereby increase the flashover distance and further reduces the possibility of a flashover.

Turning now to the drawings, FIG. 1 shows a prior art bushing insert 910 having a first end section 912 that is sealed in a bushing well (not shown), a second end section 914 that is inserted in a power cable elbow connector (not shown) and a mid-section 916 between the first and second end sections 912, 914. The mid-section 916 has a larger diameter than the first and second end sections 912, 914 and has a conductive portion 918 for attachment of a ground conductor (not shown). The mid-section 916 also has a transition shoulder portion 920 between the second end section 914 and the mid-section 916. The flashover distance "D" for the prior art bushing insert 910 extends from the shoulder portion 920, where the conductive portion 918 begins, to the power cable elbow connector end 922.

Figure 2:
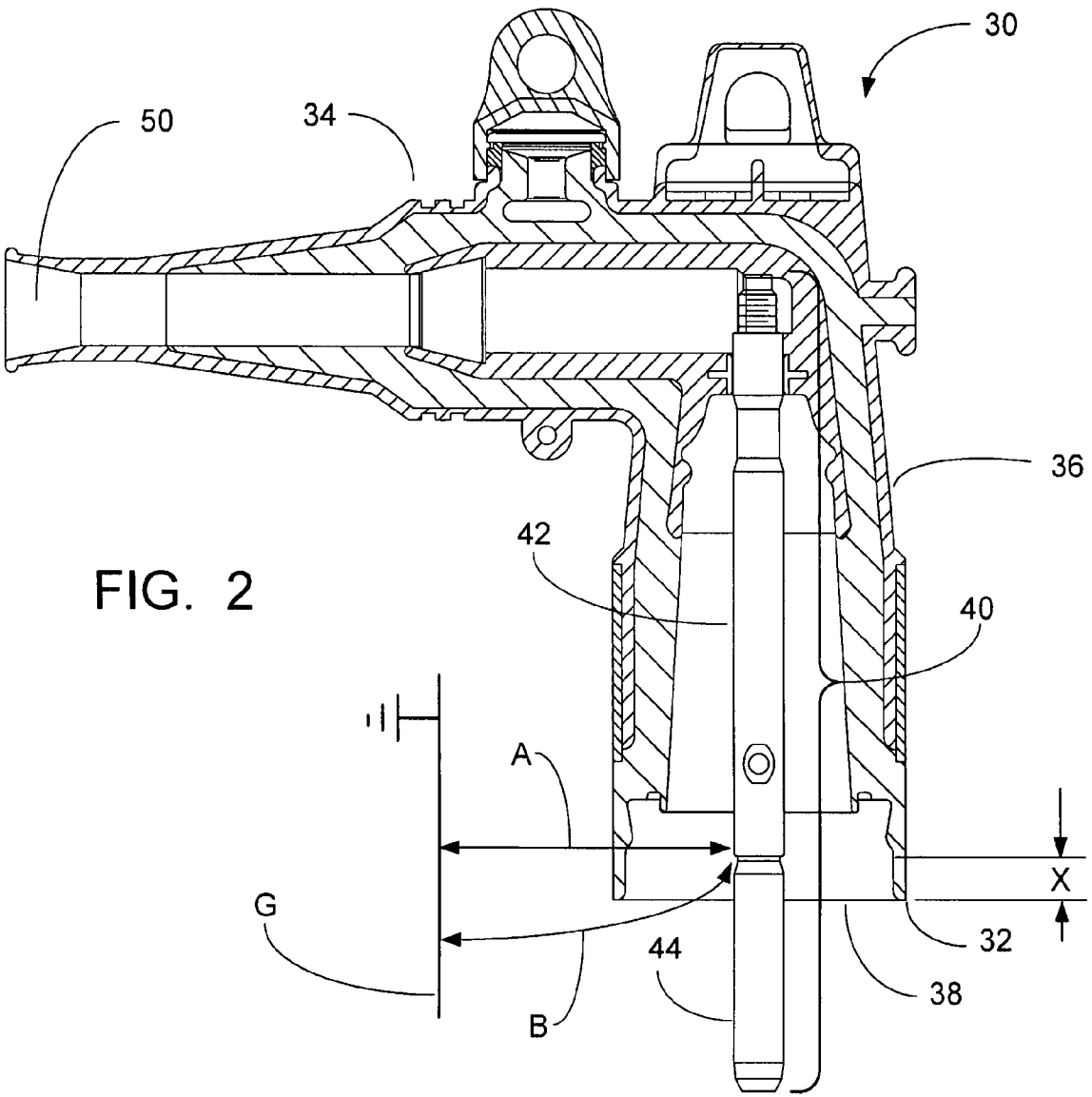
FIG. 2 is a power cable elbow of the present invention with a first embodiment of an extended insulating elbow cuff.

FIG. 2 is a power cable elbow 30 of the present invention with an extended insulating elbow cuff 32. The power cable elbow 30 includes a cable receiving end 34 that connects to a power cable 50 and a loadbreak bushing insert receiving end 36 having an open end portion 38 that connects to a bushing insert 10 (see FIG. 4). The power cable elbow 30 also includes a conductive member 40 extending from the cable receiving end 34 to the bushing insert receiving end 36. The conductive member 40 has an energized portion 42 and a non-energized portion 44 at the bushing insert receiving end 36. The extended elbow cuff 32 is circumferentially disposed around the open end portion 38 and extends beyond the energized portion 42 of the conductive member 40. The non-energized portion 44 preferably contains an arc extinguishing material so that the portion of the conductive member 40 that extends beyond the extended elbow cuff 32 cannot arc.

FIG. 2 shows how the insulating elbow cuff 32 increases the grounding distance over the prior art cuffs. The extended insulating elbow cuff 32 extends a distance "X" further than the prior art elbow cuffs. This extended distance can vary from about 0.25 inches to 2 inches. Preferably, the extended distance "X" is about 0.75 to 1.5 inches. In the prior art, the distance from the energized portion 42 of the conductive member 40 to ground G (shown here as "A") was less because of the shorter elbow cuff. The extended elbow cuff 32 of the present invention increases the distance between the ground G and the energized portion 42 to (shown here as "B") and provides additional safety for the user.

Figure 3:
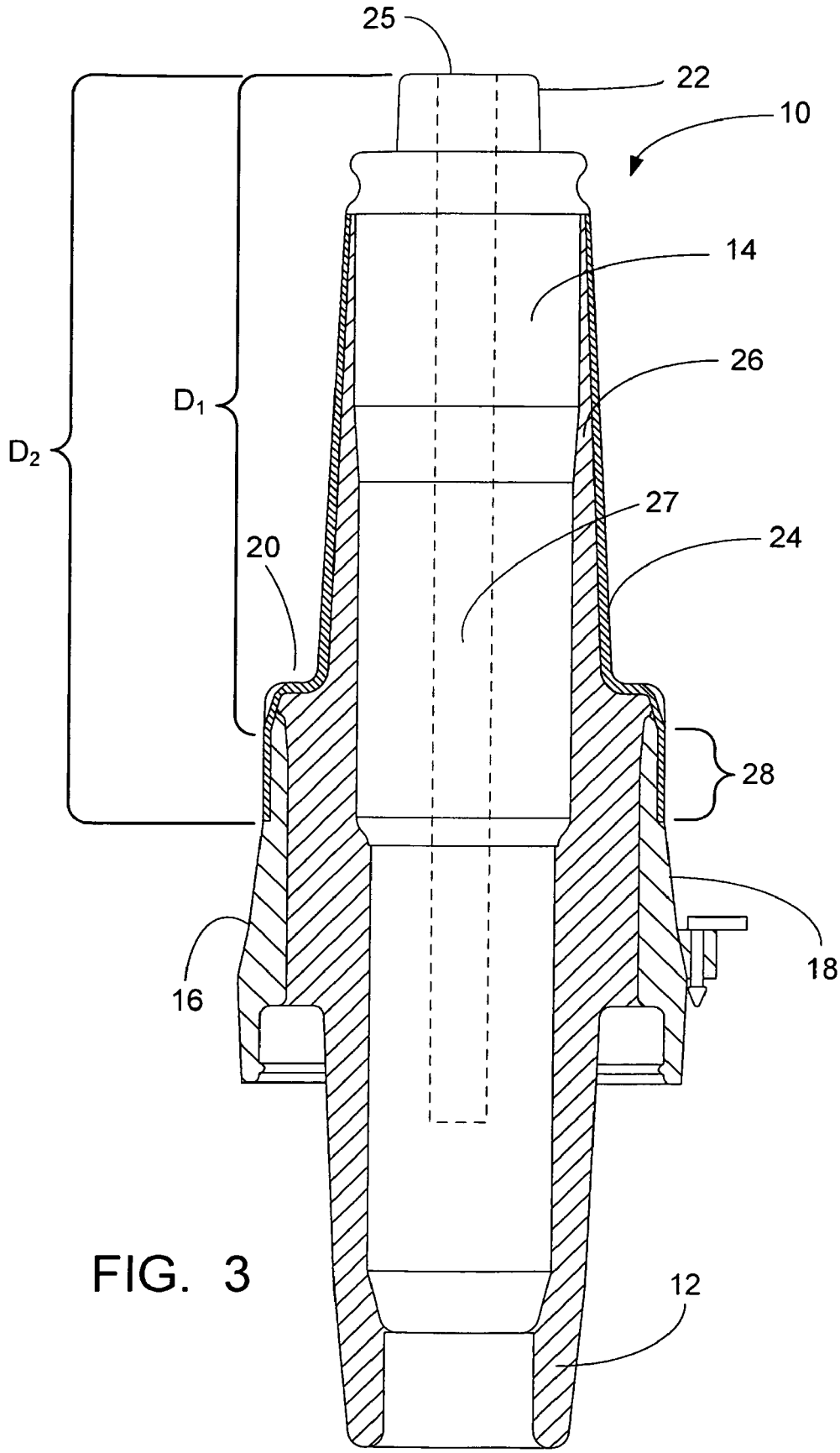
FIG. 3 is a bushing insert of the present invention with a first embodiment of a plastic sleeve extending over the outer housing from the mid-section to the power cable elbow receiving end.

FIG. 3 is the bushing insert 10 of the present invention, which has a first section 12 that is sealed in a bushing well (not shown), a second end section 14 that is inserted in a power cable elbow connector (see FIG. 4) and a mid-section 16 between the first and second end sections 12, 14. The mid-section 16 has a larger diameter than the first and second end sections 12, 14 and a conductive jacket 18 for attachment of a ground conductor (not shown). The mid-section 16 also has a transition shoulder portion 20 between the second end section 14 and the mid-section 16. A plastic or insulative sleeve 24 extends over the conductive jacket 18 and the outer housing 26 from about the middle of the mid-section 16 to a point near the power cable elbow receiving end 22. The bushing insert 10 has a bore 25 at the cable elbow receiving end 22 into which a conductive socket 27 is installed. The conductive socket 27 receives the conductive member 40 of the power cable elbow 30. The portion of the sleeve 24 that extends over the conductive jacket 18 is referred to as the extended interface sleeve section 28. The extended interface sleeve section 28 insulates the conductive jacket 18 and increases the flashover distance between the elbow receiving end 22 and the conductive jacket 18 from $D_1$ to $D_2$.

The conical bushing interface sleeve 24 is sized and shaped to fit over at least a substantial portion of the conical second (upper) end section 14 of the loadbreak bushing insert 10. The sleeve 24 has a tapered, thin-walled structure with an inner surface designed to directly contact the outer surface of the second end section 14 of the insert 10. Accordingly, the second end section 14 of the insert 10 must be sized to take into consideration the wall thickness of the sleeve 24 so that the insert 10 can be inserted into an existing elbow connector 30.

Figure 4:
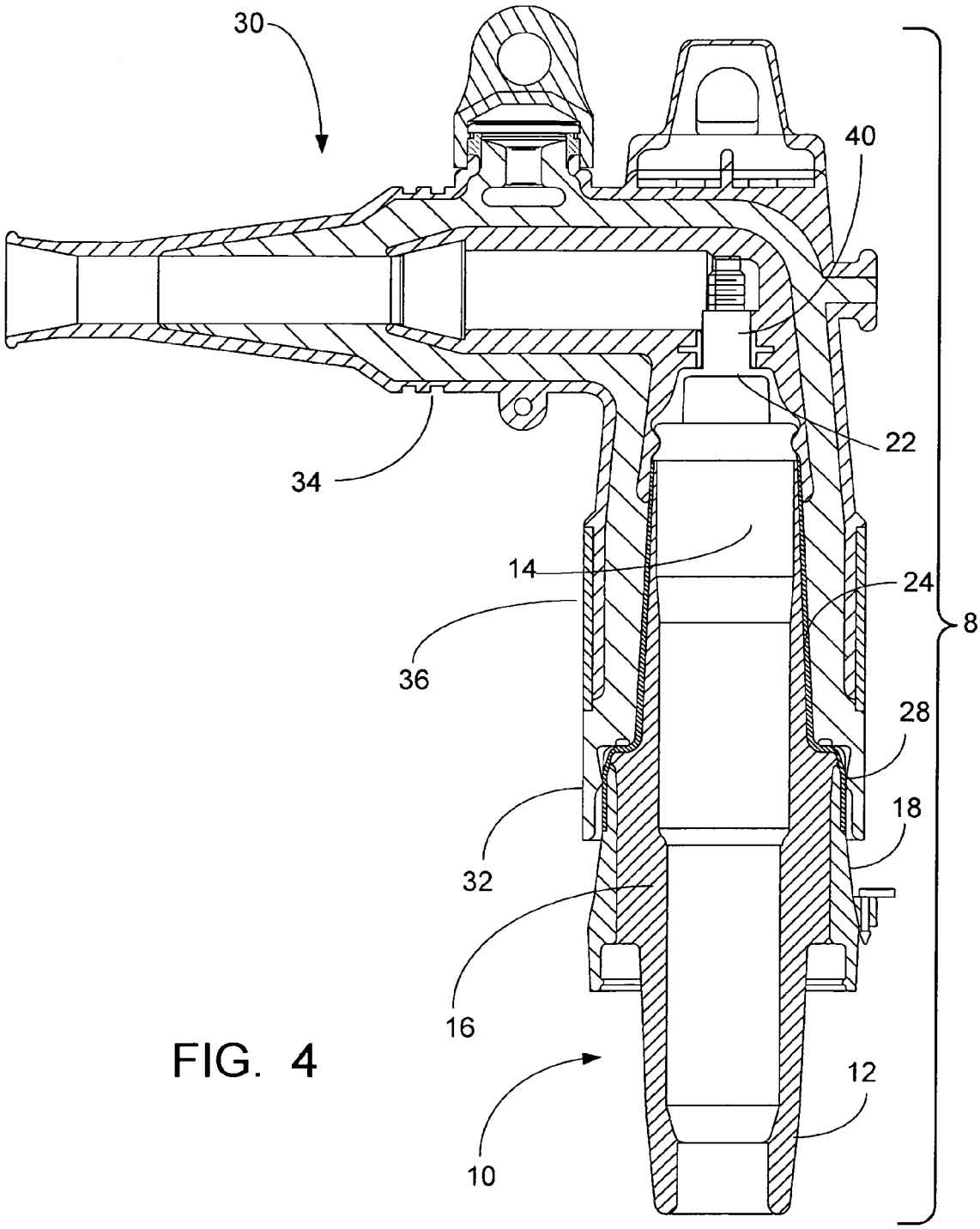
FIG. 4 is a first embodiment of a loadbreak connector with increased flashover distance of the present invention.

FIG. 4 is an embodiment of the loadbreak connector 8 with increased flashover distance of the present invention, which includes the power cable elbow 30 shown in FIG. 2 and the bushing insert 10 shown in FIG. 3. In this embodiment, when the cable elbow 30 is installed on the bushing insert 10, the extended elbow cuff 32 extends over and beyond the end of the extended interface sleeve section 28. The combination of the extended elbow cuff 32 and the extended interface sleeve section 28 increases the distance between the elbow receiving end 22 and the conductive jacket 18 of the bushing insert 10, which increase the flashover distance compared to the flashover distance "D" of the prior art bushing insert 910 shown in FIG. 1.

Figure 5:
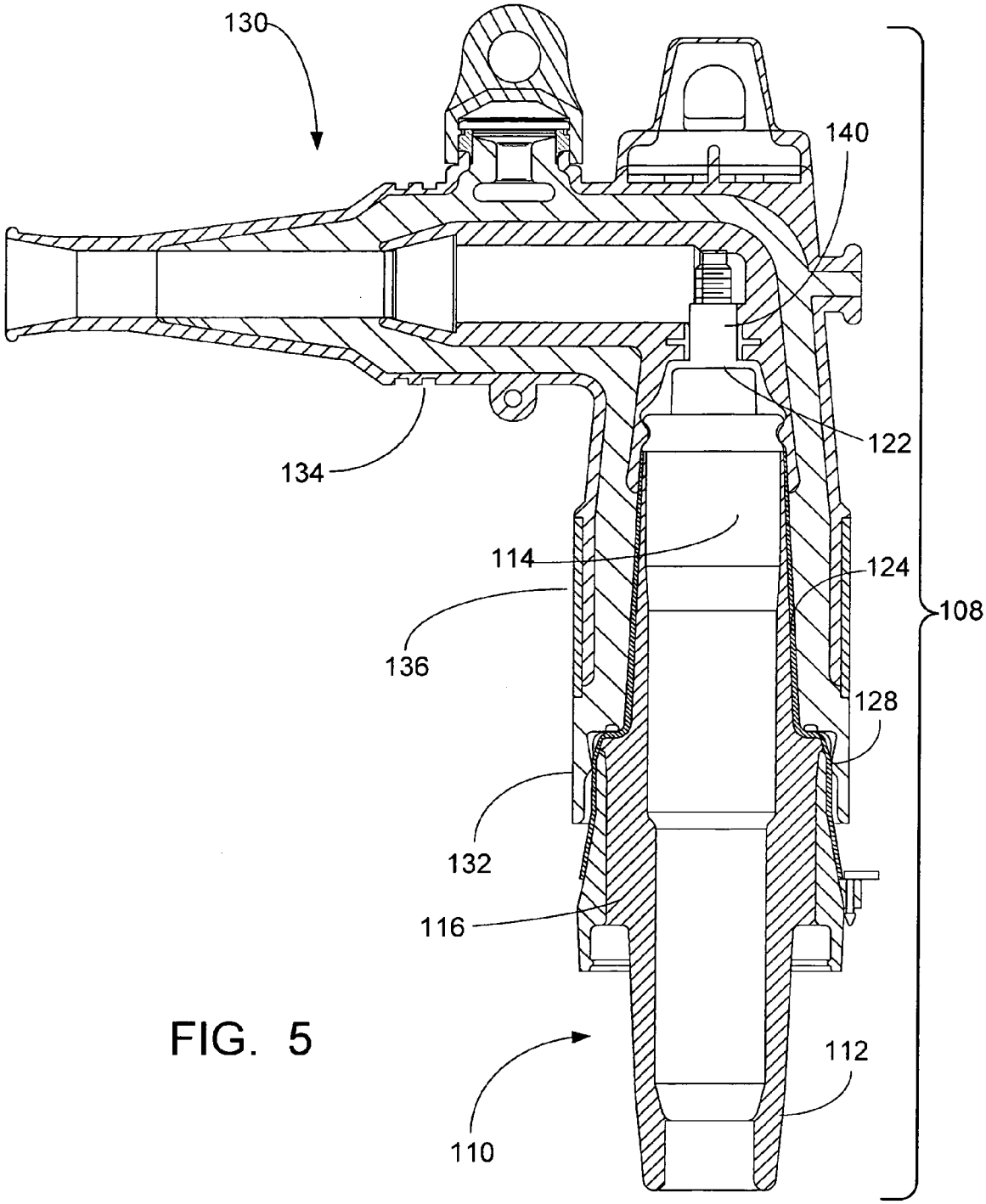
FIG. 5 is a second embodiment of a loadbreak connector with increased flashover distance of the present invention.

FIG. 5 shows another embodiment of the loadbreak connector 108 with increased flashover distance of the present invention, which is similar to the loadbreak connector 8 shown in FIG. 4. The loadbreak connector 108 includes a power cable elbow 130 and bushing insert 110. The power cable elbow 130 includes a cable receiving end 134 that connects to a power cable and a loadbreak bushing insert receiving end 136 having an open end portion that connects to the bushing insert 110. A conductive member 140 extends from the cable receiving end 134 to the bushing insert receiving end 136. The bushing insert 110 has a first section 112, a second end section 114 and a mid-section 116 between the first and second end sections 112, 114. A plastic or insulative sleeve 124 extends over the second end section 114 and the conductive jacket 118 from a point near the power cable elbow receiving end 122 to a point past the middle of the mid-section 116.

In the embodiment shown in FIG. 5, the extended interface sleeve section 128 is longer than the extended interface sleeve section 28 shown in FIG. 4 and it extends past the middle of the mid-section 116 of the bushing insert 110. When the cable elbow 130 is installed on the bushing insert 110, the extended elbow cuff 132 extends over the extended interface sleeve section 128 to about the grounding tab. The combination of the extended elbow cuff 132 and the extended interface sleeve section 128 further increases the distance between the elbow receiving end 122 and the conductive jacket 118 of the bushing insert 110, which increase the flashover distance compared to the flashover distance "D" of the prior art bushing insert 910 shown in FIG. 1.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A loadbreak connector with increased flashover distance comprising:

a power cable elbow comprising:

a cable receiving end;

a loadbreak bushing insert receiving end having an open end portion;

a conductive member extending from the cable receiving end to the bushing insert receiving end, wherein the conductive member includes an energized portion and a non-energized portion at the bushing insert receiving end; and an elbow cuff circumferentially disposed around the open end portion and extending beyond the energized portion of the conductive member; and a bushing insert comprising:

an insulative outer housing having an axial bore therethrough, a first end section dimensioned for sealing in a bushing well, a second end section dimensioned for insertion into the power cable elbow, a mid-section that is radially larger than the first and second end sections and having a conductive portion for attachment of a ground conductor, and a transition shoulder portion between the second end section and the mid-section;

a conductive socket disposed within the axial bore of the housing; and an insulative interface sleeve extending over the outer housing from the mid-section to the second end section, wherein, when the power cable elbow is installed on the second end section, the flashover distance from the top of the second end section to the bottom of the elbow cuff is increased.

2. The loadbreak connector with increased flashover distance according to claim 1, wherein the insulative interface sleeve is bonded to the outer housing.

3. The loadbreak connector with increased flashover distance according to claim 1, wherein the insulative interface sleeve has an extended interface sleeve section that extends at least one inch from the transition shoulder portion towards the first end.

4. The loadbreak connector with increased flashover distance according to claim 1, wherein, when the power cable elbow is installed on the second end section, the elbow cuff extends beyond the insulative interface sleeve.

5. The loadbreak connector with increased flashover distance according to claim 1, wherein, when the power cable elbow is installed on the second end section, the insulative interface sleeve extends beyond the energized portion of the conductive member.

6. The loadbreak connector with increased flashover distance according to claim 1, wherein, when the power cable elbow is installed on the second end section, the elbow cuff extends beyond the energized portion of the conductive member.

7. The loadbreak connector with increased flashover distance according to claim 1, wherein the insulative interface sleeve is made from a thermoplastic material with a melting temperature of at least 120° F.

8. The loadbreak connector with increased flashover distance according to claim 1, wherein the insulative interface sleeve is made from a thermosetting plastic.

9. The loadbreak connector with increased flashover distance according to claim 1, wherein the non-energized portion of the conductive member is made of a ceramic material.

10. A loadbreak connector with increased flashover distance comprising:

a power cable elbow comprising:

a cable receiving end;

a loadbreak bushing insert receiving end having an open end portion;

a conductive member extending from the cable receiving end to the bushing insert receiving end, wherein the conductive member includes an energized portion and a non-energized portion at the bushing insert receiving end; and an elbow cuff circumferentially disposed around the open end portion and extending beyond the energized portion of the conductive member; and a bushing insert comprising:

an insulative outer housing having an axial bore therethrough, a first end section dimensioned for sealing in a bushing well, a second end section dimensioned for insertion into the power cable elbow, a mid-section that is radially larger than the first and second end sections and having a conductive portion for attachment of a ground conductor, and a transition shoulder portion between the second end section and the mid-section;

a conductive socket disposed within the axial bore of the housing; and an insulative interface sleeve extending over the outer housing from the mid-section to the second end section, wherein, when the power cable elbow is installed on the second end section, the elbow cuff extends beyond the insulative interface sleeve and the energized portion of the conductive member, and wherein the flashover distance from the top of the second end section to the bottom of the elbow cuff is increased.

11. The loadbreak connector with increased flashover distance according to claim 10, wherein the insulative interface sleeve is bonded to the outer housing.

12. The loadbreak connector with increased flashover distance according to claim 10, wherein the insulative interface sleeve has an extended interface sleeve section that extends at least one inch from the transition shoulder portion towards the first end.

13. The loadbreak connector with increased flashover distance according to claim 10, wherein, when the power cable elbow is installed on the second end section, the insulative interface sleeve extends beyond the energized portion of the conductive member.

14. The loadbreak connector with increased flashover distance according to claim 10, wherein the insulative interface sleeve is made from a thermoplastic material with a melting temperature of at least 120° F.

15. The loadbreak connector with increased flashover distance according to claim 10, wherein the insulative interface sleeve is made from a thermosetting plastic.

16. The loadbreak connector with increased flashover distance according to claim 10, wherein the non-energized portion of the conductive member is made of a ceramic material.

17. A loadbreak connector with increased flashover distance comprising:

a power cable elbow comprising:

a cable receiving end;

a loadbreak bushing insert receiving end having an open end portion;

a conductive member extending from the cable receiving end to the bushing insert receiving end, wherein the conductive member includes an energized portion and a non-energized portion at the bushing insert receiving end; and an elbow cuff circumferentially disposed around the open end portion and extending beyond the energized portion of the conductive member; and a bushing insert comprising:

an insulative outer housing having an axial bore therethrough, a first end section dimensioned for sealing in a bushing well, a second end section dimensioned for insertion into the power cable elbow, a mid-section that is radially larger than the first and second end sections and having a conductive portion for attachment of a ground conductor, and a transition shoulder portion between the second end section and the mid-section;

a conductive socket disposed within the axial bore of the housing; and an insulative interface sleeve extending over the outer housing from the mid-section to the second end section, wherein, when the power cable elbow is installed on the second end section, the insulative interface sleeve extends beyond the elbow cuff and the energized portion of the conductive member, and wherein the flashover distance from the top of the second end section to the bottom of the elbow cuff is increased.

18. The loadbreak connector with increased flashover distance according to claim 17, wherein the insulative interface sleeve is bonded to the outer housing.

19. The loadbreak connector with increased flashover distance according to claim 17, wherein the insulative interface sleeve has an extended interface sleeve section that extends at least one inch from the transition shoulder portion towards the first end.

20. The loadbreak connector with increased flashover distance according to claim 17, wherein the insulative interface sleeve is made from a thermoplastic material with a melting temperature of at least 120° F.

21. The loadbreak connector with increased flashover distance according to claim 17, wherein the insulative interface sleeve is made from a thermosetting plastic.

22. The loadbreak connector with increased flashover distance according to claim 17, wherein the non-energized portion of the conductive member is made of a ceramic material.

* * * * *